United States Patent [19]

Hansen et al.

[11] 4,055,903

[45] Nov. 1, 1977

[54] METHOD AND APPARATUS FOR DRYING DISINTEGRATED FIBER MASS

[75] Inventors: Karl Erik Hansen, Kokkedal; Svend Hovmand, Horsholm; Mogens Lindskov Pedersen, Kokkedal; Christian Schwartzbach, Glostrup, all of Denmark; Myat Htun, Vallingby, Sweden; Alf de Ruvo, Stockholm, Sweden; Sören Cavlin, Saffle, Sweden

[73] Assignee: Aktieselskabet Niro Atomizer, Soborg, Denmark

[21] Appl. No.: 670,265

[22] Filed: Mar. 25, 1976

[30] Foreign Application Priority Data

Mar. 25, 1975 Sweden ..... 7503484

[51] Int. Cl.[2] ..... F26B 7/00

[52] U.S. Cl. ..... 34/12; 34/60

[58] Field of Search ..... 34/10, 11, 12, 57, 60, 34/102; 241/19

[56] References Cited

U.S. PATENT DOCUMENTS

| | | | |
|---|---|---|---|
| 3,812,595 | 5/1974 | Engelhart et al. | 34/57 R |
| 3,836,085 | 9/1974 | Brown | 241/19 |
| 3,890,220 | 6/1975 | Anderson | 241/19 |

*Primary Examiner*—John J. Camby

*Attorney, Agent, or Firm*—Dennison, Dennison, Meserole & Pollack

[57] ABSTRACT

A method and apparatus for drying disintegrated fiber mass or paper pulp comprising substantially free single fibers and wads or lumps of fibers. The disintegrated fiber mass is exposed to hot drying air or gas at a temperature of at least 180° C. Free fibers are separated from the fiber mass during or after the drying process in order to avoid or compensate for excessive heating and drying of these free fibers. This facilitates a later grinding process in which the dried fiber mass is ground after addition of water.

24 Claims, 6 Drawing Figures

METHOD AND APPARATUS FOR DRYING DISINTEGRATED FIBER MASS

BACKGROUND OF THE INVENTION

1. Field of the Invention

The present invention relates to a method of pneumatic drying disintegrated fiber mass which includes cellulose fibers and is intended for use in the manufacture of paper products.

2. Description of the Prior Art

In conventional drying of cellulose fiber mass or paper pulp, the fiber mass which is in the form of a slurry is applied to a dewatering press in which the fiber slurry is drained and formed to a web which is thereafter exposed to a flow of hot air or passed over steam heated cylinders. Due to relatively slow diffusion of water in the compact web-shaped fiber mass a relatively long drying period is necessary in order to reduce the moisture content to the value desired.

During recent years cellulose fiber mass has also been dried by a pneumatic drying process which is known as a flash drying process. By such flash drying the fiber mass to be dried is supplied into a flow of relatively hot drying air in a disintegrated condition. Due to the fact that a relatively great surface of the disintegrated fiber mass is contacted by the drying air and due to the relatively high drying air temperature which is normally between 250° and 400° C, a relatively short drying period may be obtained by a flash drying process. After drying the fiber mass may be separated from the drying air, for example by means of a cyclone.

The dried fiber mass may be pressed into bales and shipped to customers or consumers such as paper manufacturers. When the dried fiber mass is to be used for making paper, paper board, or other paper goods the fiber mass is suspended in water and subjected to a grinding process.

It has been found that under certain conditions flash dried cellulose fiber mass is more difficult to grind than corresponding cellulose fiber mass which has been web dried in a conventional manner. That means that in order to obtain the same characteristics of the final product a higher amount of power is required for grinding flash dried fiber mass than for grinding web dried fiber mass. This fact has apparently counteracted a more widespread use of flash drying in connection with cellulose fibers to be used in the paper industry.

SUMMARY OF THE INVENTION

It has now surprisingly been found that the reduced grindability of flash dried cellulose fibers is due to the fact that the disintegrated fiber mass contains a fraction of more or less free single fibers in addition to small wads or lumps of fibers, and that these free fibers are exposed to excessive heating or overdrying when the drying process is continued till the fiber wads obtain a suitable degree of dryness. The present invention is based on this finding.

Therefore, the present invention provides a method of drying fiber mass intended for use in the manufacture of paper products and disintegrated so as to comprise substantially free single fibers, of which at least a part is cellulose fibers, and wads or lumps of fibers, said method comprising exposing the disintegrated fiber mass to drying gas or air at a temperature of at least 180° C and separating a substantial part of the free fibers from the disintegrated fiber mass, when at least partly dried.

It has been found that by separating a fraction of free or substantially free single fibers (which are found to be responsible for the reduced grindability of the fiber mass as explained above) from the main fraction, the grindability of that main fraction will be substantially improved compared to fibers which have been processed in accordance with known flash drying processes, and thus, the fiber mass in the main fraction obtained by the method according to the invention has characteristics comparable with the characteristics of web dried fiber mass.

In flash drying materials composed of various size particles it is known to separate the smaller particles from the main stream of material and drying air in order to decrease the residence time for the smaller particles so as to avoid the risk of burning or decomposing the material in these particles and in order to increase the efficiency of the flash dryer. In connection with drying of various size particles it is also known to divide the particles into a fraction of smaller particles which may be airborne and into a fraction of larger particles which may not be airborne (Swedish Pat. No. 185,424). However, it is believed that it has not previously been proposed to separate free single fibers from a fiber mass being flash dried, neither has it previously been realized that the general teaching of separating smaller particles would be of any importance in flash drying a disintegrated cellulose fiber mass which has been considered rather homogeneous.

In accordance with the invention the free fibers are preferably separated before or immediately after drying of the fiber mass is terminated. However, in principle it is also possible to separate the free fibers at any time after termination of the drying process by using a separate separating process. The separated free fibers may be used for any suitable purpose which may depend on the characteristics imparted to the free fibers during the drying process. As an example, in accordance with the invention the separated free fibers may be used for making a non-woven paper-like product by a dry process. In manufacturing such a product it is advantageous that the raw material has the form of substantially free fibers which do not stick together to any substantial extent.

When drying of the fiber mass is performed in two or more stages — which is normally the case — the separation of free single fibers may according to the invention, advantageously take place between two successive drying stages. Thus, the separated fraction of free fibers will pass a number of drying stages which is less than the number of drying stages being passed by the main fraction of fiber mass whereby the free fibers will be less deteriorated by the heat treatment than if they had been passed through all drying stages together with the main fraction. By removing the free fibres at a suitable location during the drying process, overdrying and reduction of grindability of the free fibers may even be totally avoided. If it is desired to separate a relatively large fraction of free fibers from the dried fiber mass this may be obtained by disintegrating the wet fiber mass very intensively before drying.

Even though the method according to the invention has proved especially advantageous in connection with drying of cellulose fiber mass it should be understood that the method may also be used in connection with other types of fibers where an overdrying of free fibers in the disintegrated fiber mass may also adversely effect the dried product.

It is preferred to perform the drying in two stages and to separate free fibers between these stages. In each stage the fiber mass is preferably conveyed by the drying gas, and drying gas from the second drying stage may preferably be used as drying gas in the first drying stage, whereas drying gas may be supplied to the second drying stage directly from the source of drying gas.

As indicated above, the fraction of free fibers separated from the main fraction in accordance with the present invention may be used for other purposes than that of the main fraction. When, however, drying is performed in two or more stages, and the free fibers are separated at such a position between two successive stages that they have not yet been overdried or otherwise exposed to an excessive heat treatment the separated free fibers may again be mixed with the remaining, non-separated fraction of the fiber mass when said remaining fraction has been exposed to drying treatment in one or more further stages. That means that the free fibers — provided that they have a suitable degree of dryness when separated — may be mixed with the non-separated fraction of the fiber mass when the drying treatment of that main fraction has been terminated. Alternatively, the separated fibers may — if they have a too high degree of moisture after separation — pass the last drying stage or stages together with the non-separated main fraction of the fiber mass. It should be understood that in both cases the free fibers will follow a shorter drying path than the fiber wads or lumps, whereby all fibers in the dried product may obtain substantially the same degree of dryness corresponding to that desired.

The separation of free fibers may take place in any suitable manner, for example by utilizing the fact that the ratio between air resistance and inertia is greater for free fibers than for fiber wads or lumps. Therefore, the free fibers are better able to follow a sudden change of direction for the drying gas than the fiber wads, and as an example free fibers may be separated from fiber wads or lumps by passing drying gas and fiber mass through a tube bend with a deflection wall or plate arranged therein. Separation of free fibers may according to the invention alternatively be effected by passing a flow of gas or air conveying the fiber mass, through a cyclone which is adapted so as to let free single fibers pass therethrough together with the gas or air flow, but to separate fiber wads or lumps therefrom.

The invention also relates to an apparatus for drying a fiber mass of the type used in manufacturing paper products, said apparatus comprising means for disintegrating the fiber mass so as to comprise substantially free single fibers and wads or lumps of fibers, means for exposing the disintegrated fiber mass to a flow of hot drying air or gas, and means for separating at least partly dried free single fibers from the fiber mass.

Furthermore, the invention relates to a product produced by the method described above.

BRIEF DESCRIPTION OF THE DRAWING

The invention will now be described more in detail with reference to the diagrammatic drawings wherein.

DESCRIPTION OF THE PREFERRED EMBODIMENTS

Figure 1:
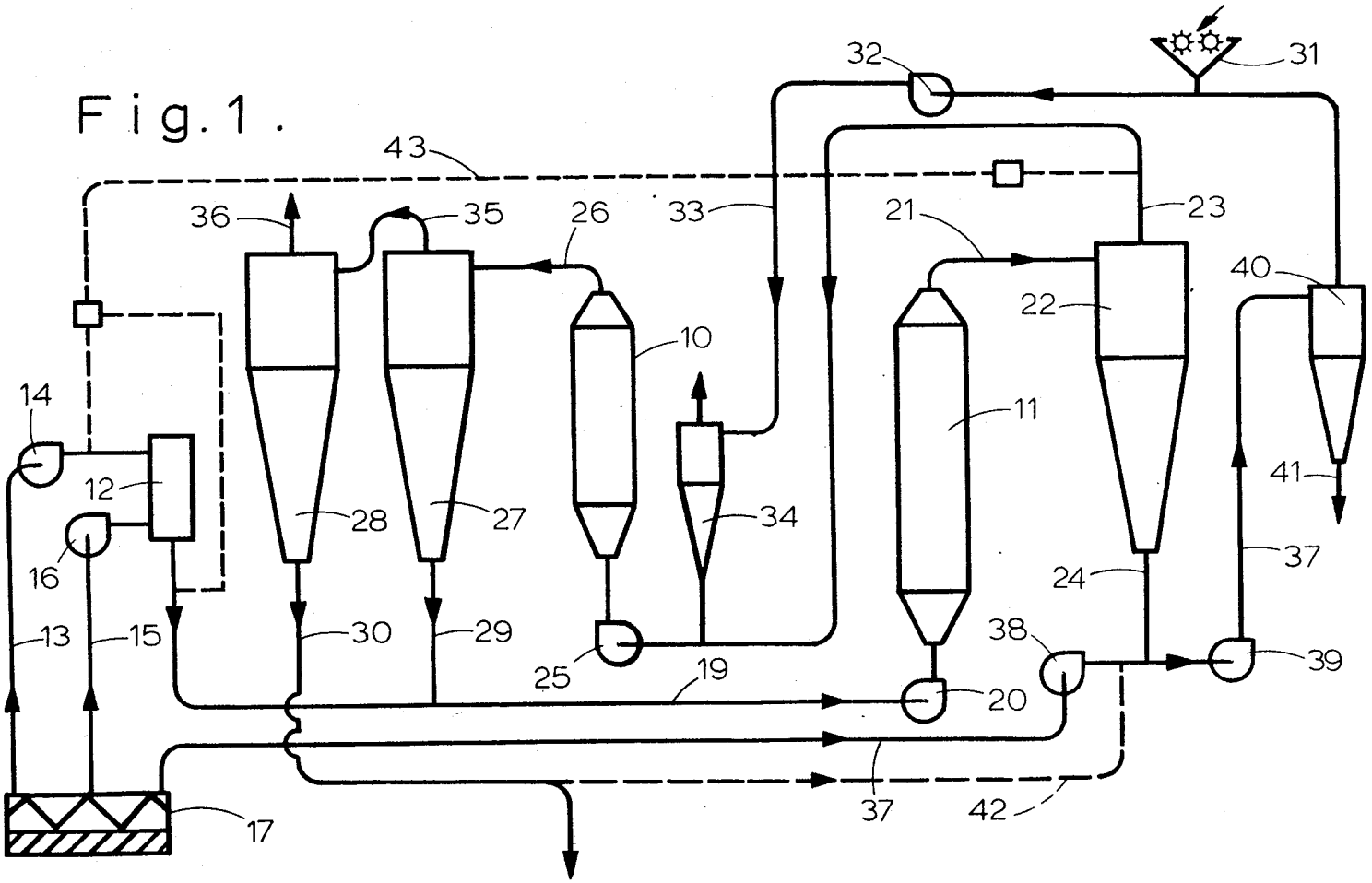
FIG. 1 shows an apparatus or system for carrying out a method according to the invention.

The flash drying system shown in FIG. 1 is a two-stage system in which a processing or drying chamber 10 constitutes the first stage whereas the second drying stage is constituted by a processing or drying chamber 11. Warm drying gas which is used in the flash drying system is produced by an air heater 12 which may for example be an oil burner. Combustion air is supplied to the oil burner through a conduit 13 by means of a fan or blower 14, and the air to be heated by the oil burner 12 is supplied through a conduit 15 by means of a fan or blower 16. The combustion air as well as the air to be heated are preferably taken in through a filter 17. The combustion gas generated by combustion in the oil burner 12 is discharged from the air through a discharge tube 18, and heated air supplied from the conduit 15 is passed to the drying chamber 11 constituting the second drying stage, through an inlet conduit 19 by means of a fan or blower 20. The oil burner may, of course, be replaced by any other conventional type of air heater having the necessary capacity and being sufficiently economical in use.

Through an outlet conduit 21 the drying chamber 11 is connected to a cyclone 22 which is adapted to separate the drying gas and material to be dried, the drying gas being discharged from the cyclone through a gas outlet conduit 23, and the material to be dried leaving the cyclone 22 through an outlet conduit 24 connected to the bottom of the cyclone. The gas outlet conduit 23 is connected to the drying chamber 10 constituting the first drying stage via a fan or blower 25. Through an outlet conduit 26 this drying chamber 10 is again communicating with two cyclones 27 and 28 connected in series. The material outlet conduit 29 of the cyclone 27 is connected to the drying gas inlet conduit 19 whereas the material outlet conduit 30 of the cyclone 28 preferably passes out from the system.

The flash drying system illustrated in FIG. 1 is adapted for drying of fiber mass, preferably cellulose fiber mass. Such fiber mass is preferable made from cellulose pulp or paper pulp which is subjected to a mechanical dewatering process, for example in a dewatering press having two perforated cylinders. The dewatered cellulose mass is passed to a disintegrator 31, preferably a so-called "fluffer" which disintegrates the fiber mass into small fiber wads which are then blown through a supply conduit 33 for fresh fiber mass by means of a fan or blower 32. The gas or air used in the pneumatic conveyance of the fiber wads in the conduit 33 is separated from the untreated fiber mass in a cyclone 34, and the fiber mass continues into the gas discharge conduit 23 where it is mixed with the drying gas flowing out from the drying chamber 11 in which drying at the second stage is being performed. The untreated fiber mass which is a mixture of fiber wads and more or less free single fibers, is then blown into the drying chamber 10 constituting the first drying stage by means of a fan 25 together with the drying gas which has already been used in the second drying stage. In the chamber 10 the disintegrated fiber mass is heated and thereby freed from part of its moisture content.

The completely free or substantially free single fibers in the fiber mass will be contacted by the drying gas at a surface which in relation to the total moisture content is substantially greater than for coherent or tangled fibers forming fiber lumps or fiber wads. Consequently, in the drying chamber 10 these single fibers will be subjected to a more heavy drying treatment than the fibers forming part of the fiber wads. By a suitable dimensioning of the system and by choosing a suitable drying gas temperature it may be obtained that drying of the more or less free single fibers is terminated when they leave the drying chamber 10 through the outlet conduit 26, whereas this is not true for the fiber wads or fiber lumps. The cyclone 27 is therefore of a less efficient type, i.e. of a type separating the fiber wads or fiber lumps from the drying gas whereas the free single fibers and very small fiber wads may follow the flow of drying gas into the cyclone 28 through a connection conduit 35. The cyclone 28 is of a more efficient type which separates substantially all remaining fibers from the drying gas which may now leave the system through a discharge tube 36. The separated dried free single fibers and very small fiber wads are discharged from the apparatus or system through the outlet conduit 30 and may then be used for special purposes, for example in the manufacture of paper products by a dry process. However, the dried single fibers may also again be mixed with the main portion or fraction of the fiber mass when also drying of this main fraction has been terminated, as will be described below.

The part or fraction of the fiber mass which has been separated in the cyclone 27 and which is not yet sufficiently dried is passed through the conduit 29 into the supply conduit 19 for fresh drying gas, and the fiber mass and drying gas is now blown into the drying chamber 11 constituting the second drying stage by means of the fan 20. In the chamber 11 the fiber wads are subjected to a heavy heat treatment by the hot and dry heating gas whereby the moisture content of the fiber mass is reduced to the value desired. The drying gas and dried fiber mass leave the drying chamber 11 through the outlet conduit 21 and are passed into the cyclone 22 where the fiber mass is separated from the drying gas. The drying gas is then supplied to the drying chamber 10 constituting the first drying stage, through the gas outlet conduit 23 as previously explained. The separated dried fiber wads are passed through the outlet conduit 24 into a conveyor conduit 37 provided with a pair of fans or blowers 38 and 39 which are taking in air through the filter 17 and blowing the dried fiber mass supplied from the conduit 24 into a cyclone 40 where the fiber mass is separated from the conveying air and leaves the cyclone 40 through a discharge tube 41. The conveying air is sucked from the cyclone 40 by means of the fan 32 and is thus used for transporting the wet fiber mass supplied from the fluffer 21 to the cyclone 34.

In case the dried free fibers which are discharged from the cyclone 28 through the outlet conduit 30 should not be used for special purposes but should be mixed with the main fraction of fiber mass leaving the cyclone 22, the conduit 30 may be connected to the conveyor conduit 37 between the fans 38 and 39 as indicated by a dotted line 42. Furthermore, the drying gas which has been used at the second drying stage in the drying chamber 11 and which is separated in the cyclone 22 may be diluted either by fresh air from the fan 14, or by fresh drying gas from the conduit 18 as indicated by a dotted line 43.

Figure 2:
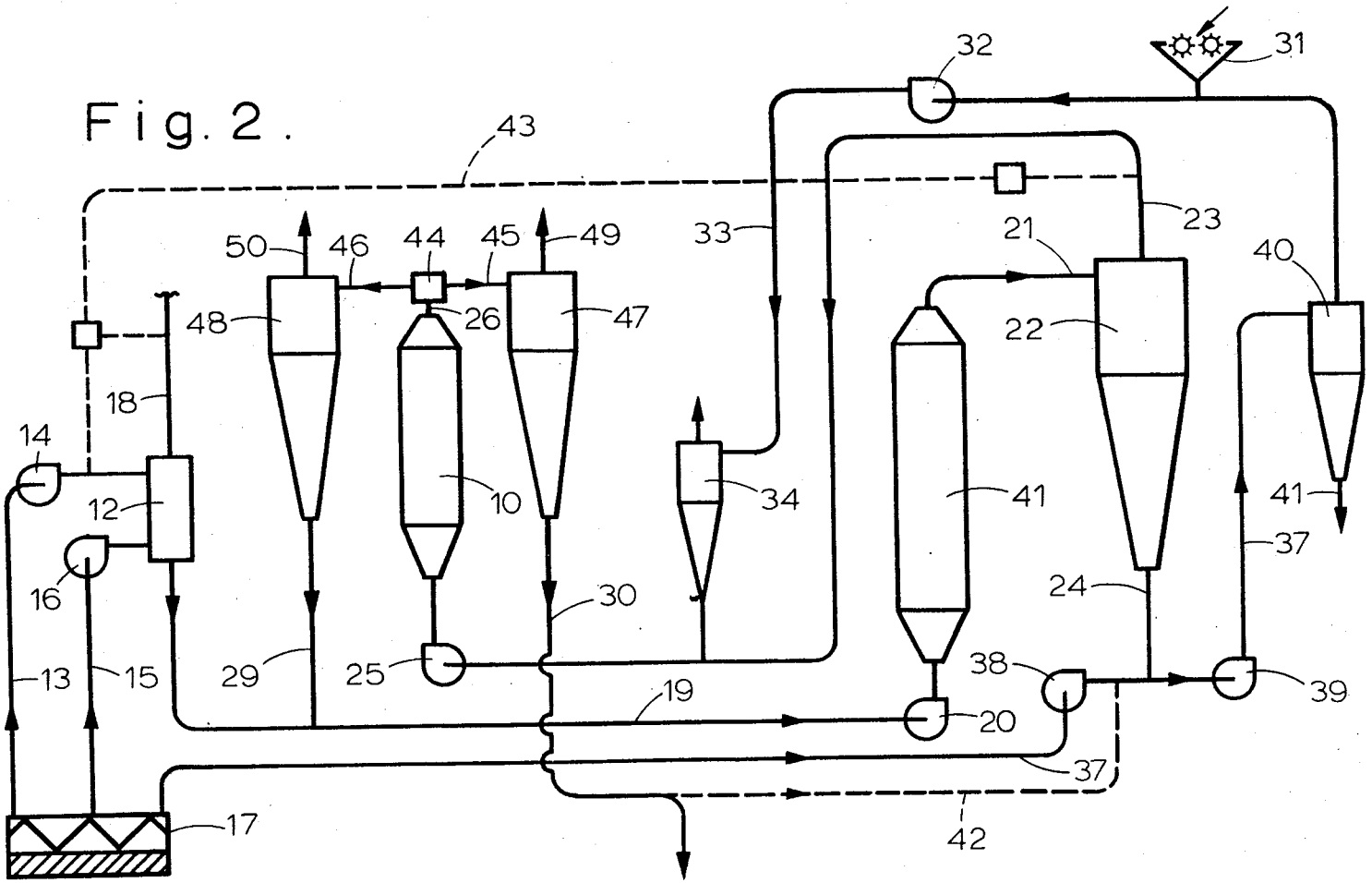
FIG. 2 a modified embodiment of the system shown in FIG. 1.

FIG. 2 shows a flash drying system corresponding to that of FIG. 1 with the exception that the cyclone arrangement which in FIG. 1 includes the cyclones 27 and 28 and being used for separating the dried free single fibers from the still humid fiber lumps or fiber wads, has been replaced by another cyclone arrangement.

Figure 3:
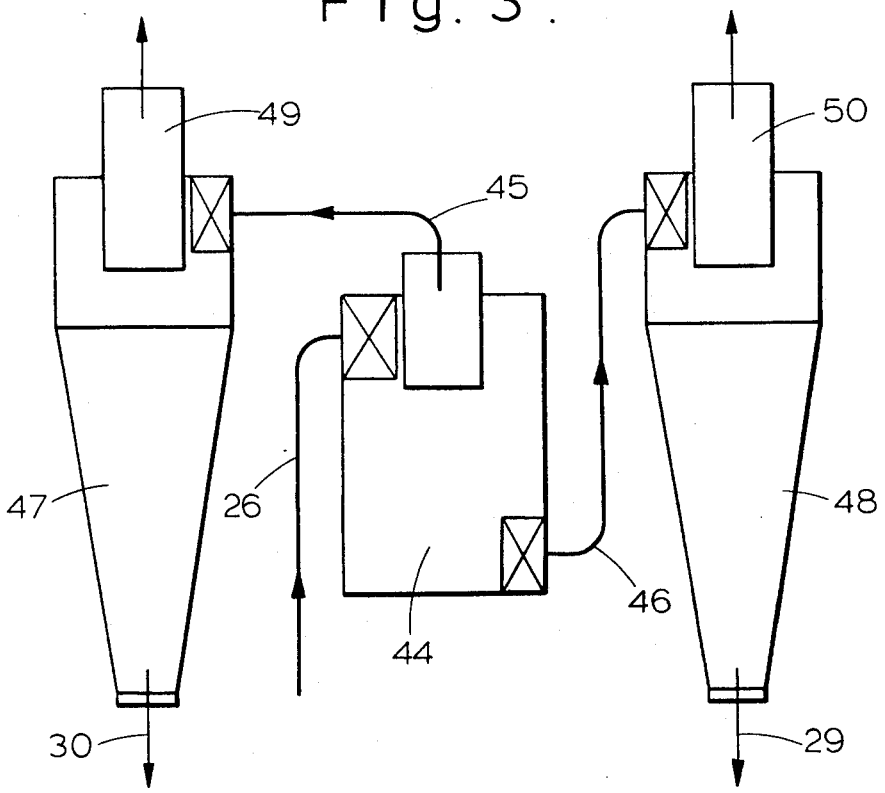
FIG. 3 in enlarged scale a side view of a cyclone arrangement included in the system shown in FIG. 2, FIG. 4 a plan view of the cyclone arrangement shown in FIG. 3, FIG. 5 a side view of another embodiment of the cyclone arrangement, and FIG. 6 a plan view of the cyclone arrangement shown in FIG. 5.
Figure 4:
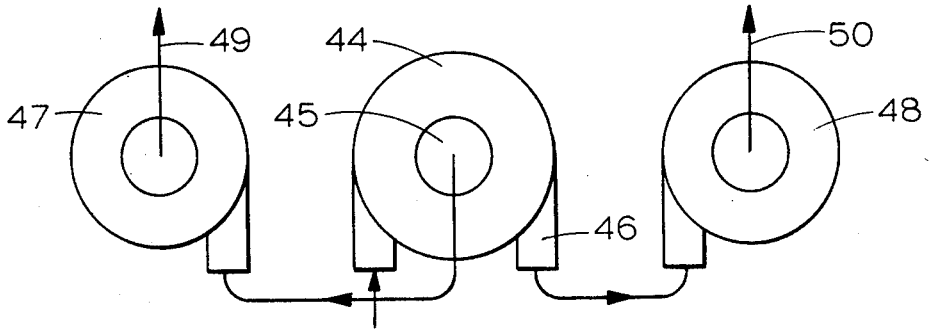

In the system shown in FIG. 2 the flow of drying gas and fiber mass from the drying chamber 10 constituting the first drying stage is passed into a centrifugal separator 44 which is shown more in detail in FIG. 3 and 4. The flow of drying gas and fiber mass from the drying chamber 10 is passed through the conduit 26 and tangentially into the upper part of the separator. The said flow may leave the separator either through a centrally arranged upper discharge tube 45, or through a tangentially arranged lower discharge tube 46. The relatively heavy fiber lumps or fiber wads which are not yet fully dried will tend to move helically along the peripheral wall of the separator 44 under the influence of centrifugal forces and leave the separator through the tangential discharge tube 46. The centrifugal forces influencing the lighter single fibers are, however, less important compared to the gas flow influences to which these fibers are subjected. Therefore, these single fibers will flow through the central discharge tube 45 together with part of the drying gas. The discharge tubes 45 and 46 are each connected to one of two cyclones 47 and 48, respectively, in which the drying gas is separated from the entrained fibers. The drying gas leaves these cyclones through drying gas discharge tubes 49 and 50, respectively, and the fiber mass separated in the cyclone 48 and not yet sufficiently dried is passed through the outlet conduit 29 into the supply conduit 19 for fresh drying gas whereas the sufficiently dried single fibers from the cyclone 47 are passed out from the system through the discharge conduit 30 or into the conveying conduit 37 as previously described.

Figure 5:
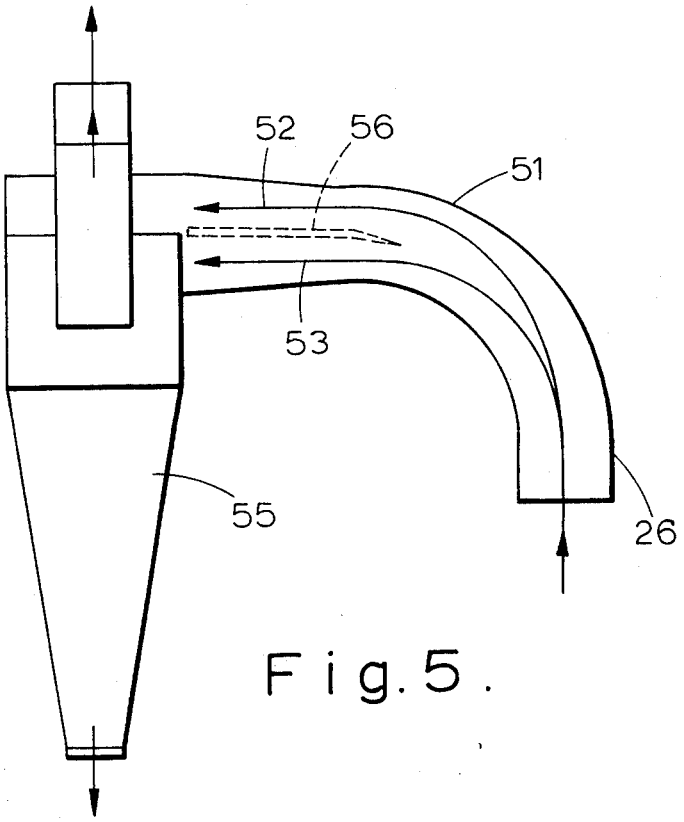
Figure 6:
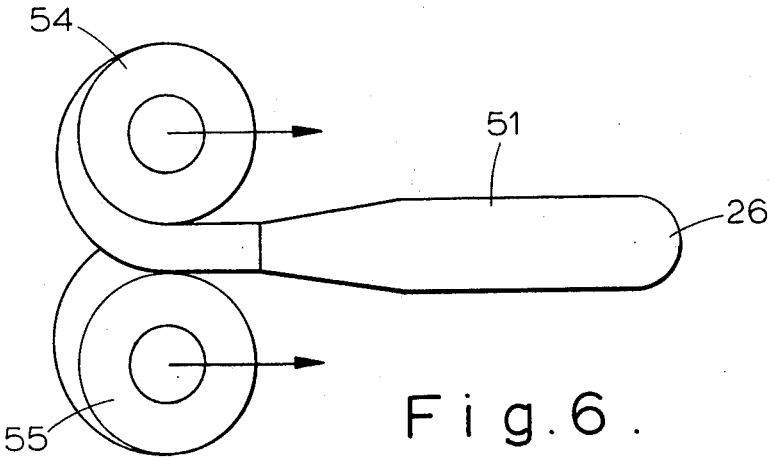

It should be understood that other types of separating devices may be used for separating sufficiently dried single fibers from the insufficiently dried main fraction of fiber mass. FIGS. 5 and 6 show such an alternative separating device including a tube bend 51 formed on the outlet conduit 26 from the drying chamber 10. When the mixture of sufficiently dried single fibers and insufficiently dried fiber lumps or wads flows through the tube bend 51 together with drying gas, the fiber mass will be influenced by centrifugal forces causing a stratification of the fiber mass in the tube bend so that the insufficiently dried portion of the fiber mass (which is indicated by an arrow 52 in FIG. 5) will tend to move as far as possible from the center of curvature of the bend, whereas the sufficiently dried single fibers (indicated by an arrow 53 in FIG. 5) will tend to move closer to that center of curvature. Consequently, the insufficiently dried fiber mass will be passed into a cyclone 54, and the sufficiently dried free single fibers will be passed into a cyclone 55, see FIG. 6. As indicated by dotted lines a separating plate 56 which may be adjustable, if desired, may be arranged within the tube bend 51. As a further example of separating devices which may be used in connection with a flash drying system of the type described, reference is made to the device shown in FIG. 1 of the West German Patent Specification No. 1,245,267.

Laboratory examinations of cellulose fibers in for example bleached sulphate mass have shown that the mechanical characteristics of the fibers are substantially unchanged after repeated heat treatments by which the temperature does not exceed 180° C. However, already at a temperature of 210° C the fiber stiffness is clearly increased, the water absorbing ability of the fibers is decreased, and the fibers become more brittle. This seems to show that in order to avoid that flash drying deteriorates the mechanical characteristics of cellulose fibers in bleached sulphate mass the drying gas temperature should either not exceed 180° C, or it should be prevented that any part of the fiber mass during any part of a drying process is dried to such an extent that the temperature of the single fibers exceeds that critical temperature.

Microscopic examinations of flash dried fibers show that the heavy heat treatment of the fibers results in that the fibers obtain a helically twisted structure, and the degree of twisting increases by increasing drying gas temperature. Thus, when the fibers are subjected to temperatures not exceeding 180° C "long-waved" twisted structures are obtained and the fibers are relatively easily straightened out when they are later suspended in water and ground. However, fibers which have been subjected to a temperature of more than approximately 200° C obtain a typical "short-waved" twisted structure of more permanent nature. Such "short-waved" twisted fibers are not straightened out when they are suspended in water and even when subjected to a heavy grinding process.

EXPERIMENTS

Experiments were made by using a flash drying system corresponding to that shown in FIG. 1 with the exception that the cyclones 27 and 28 were replaced by a single cyclone which separated all of the fiber material and passed it to the supply conduit 19 so that also the free single fibers were dried in both drying stages in conventional manner. Bleached sulphate pulp with a solid matter content of 48% by weight was supplied to the system at the fluffer 31, and the temperature of the drying gas flowing through the conduit 19 from the heater 12 was 260° C. After having passed the second drying stage, i.e. immediately downstream of the cyclone 22 the temperature of the drying gas was reduced to 130° C, and after having passed the first drying stage the temperature of the drying gas was reduced to about 70° C. After having passed the first drying stage the average solid matter content of the pulp of fiber mass was increased to 56% by weight, and after the second drying stage, i.e. at the exit of the cyclone 22 the average solid matter content had been increased to 88–90% by weight.

Measurements showed that after the first drying stage the content of relatively free fibers was about 25% calculated on the basis of the weight of solid matter in the fibers, and that the solid matter content of these free fibers was about 90% by weight even though the average content of solid matter after the first drying stage was only 56% as mentioned above. Free fibers were also separated after the second drying stage, and for these free fibers the content of solid matter was found to be 96% by weight whereas the average content of solid matter in the fiber mass after the second drying stage was 88–90% as previously mentioned. It is probable, however, that the free fibers have been even more dry, because it should be realized that it could hardly be avoided that the fibers absorbed humidity from the atmosphere when the sample was taken out from the system.

Samples of free fibers taken out after the first and second drying stages, respectively, and samples of the non-separated fiber mass taken out after the second drying stage were ground in a grinding mill sold under the trade name Escher Wyss. It was found that the free fibers taken out after the second drying stage showed a substantially reduced grindability and strength and poorer mechanical characteristics as a whole compared to the non-free fibers taken out after the first drying stage. However, the free fibers taken out after the first drying stage showed better mechanical characteristics than the flash dried non-separated mass taken out after the second drying stage. These facts seem to indicate that the free fibers taken out after the second drying stage have been subjected to an overdrying and thus heated in the second drying stage to temperatures exceeding the previously mentioned critical temperatures of 180° or 210° C. Thereby a permanent "short-waved" twisted structure indicating the poorer mechanical characteristics has been imparted to the fibers.

It should be understood that various modifications and amendments of the embodiments described above may be made within the scope of the present invention. It should also be stressed that although in the foregoing the invention has generally been described with reference to cellulose fibers, the invention might also be used in connection with flash drying of masses consisting of or including other types of fibers.

We claim:

1. In a method of flash drying a fiber mass generally requiring subsequent grinding in an aqueous slurry in the manufacture of paper products wherein the fiber mass to be dried is disintegrated to comprise a disintegrated fiber mass which comprises substantially free single fibers, of which at least a part of the free single fibers are cellulose fibers, and wads or lumps of fibers and then the disintegrated fiber mass is subjected to a drying gas the improvement comprising exposing the said disintegrated fiber mass to flash drying by utilization of a drying gas at a temperature of at least 180° C, to at least partially dry the free fibers and then separating a substantial part of the free fibers from the wads and lumps of the disintegrated fiber mass whereby the grindability of the free fibers is not substantially reduced.

2. A method according to claim 1, wherein the free fibers are separated before flash drying of the fiber mass is terminated.

3. A method according to claim 1, wherein the free fibers are separated when flash drying of the fiber mass has been terminated.

4. A method according to claim 1, further comprising using said separated free fibers for making a non-woven paper-like product by a dry process.

5. A method according to claim 1, wherein flash drying of the fiber mass is being performed in at least two stages, then at least partially dried free fibers being separated between two successive flash drying stages.

6. A method according to claim 5, further comprising mixing the separated fibers with the wads and lumps comprising a remaining fraction has been exposed to flash drying treatment in at least one further stage.

7. A method according to claim 5, wherein said separation of free fibers is effected by passing a flow of gas or air conveying the fiber mass, through a cyclone which is adapted so as to let free single fibers pass therethrough together with the gas or air flow, but to separate fiber wads or lumps therefrom.

8. A method according to claim 1, wherein the free fibers are being separated before they have been heated to a temperature of about 180° C.

9. A method according to claim 1, wherein the free fibers are being separated before their contents of solid matter exceed 90% by weight.

10. A method according to claim 1, wherein the fibrous mass is a mass of paper pulp

11. A method according to claim 10, wherein the pulp mass is disintegrated by means of a fluffer.

12. A method according to claim 10, wherein the free fibers are separated before flash drying of the fiber mass is terminated.

13. A method according to claim 10, further comprising using said separated free fibers for making a non-woven paper-like product by a dry process.

14. A method according to claim 10, wherein flash drying of the fiber mass is being performed in at least two stages, the at least partially dried free fibers being separated between two successive flash drying stages.

15. A method according to claim 10, further comprising mixing the separated fibers with the wads and lumps comprising a remaining, non-separated fraction of the fiber mass when said remaining fraction has been exposed to drying treatment in at least one further flash drying stage.

16. A method according to claim 10, wherein said separation of free fibers is effected by passing a flow of gas or air conveying the fiber mass, through a cyclone which is adapted so as to let free single fibers pass therethrough together with the gas or air flow, but to separate fiber wads or lumps therefrom.

17. A method according to claim 10, wherein the at least partially dried free fibers are being separated before they have been heated to a temperature of above 180° C.

18. A method according to claim 10, wherein the at least partially dried free fibers are being separated before their contents of solid matter exceed 90% by weight.

19. A product produced by the method according to claim 1.

20. A product produced by the method according to claim 10.

21. An apparatus for flash drying a fiber mass generally requiring subsequent grinding in an aqueous slurry in manufacturing paper products, said apparatus comprising in combination means for disintegrating the fiber mass to be flash so as to comprises a mixture of substantially free single fibers and wads or lumps of fibers, flash dryer means receiving the disintegrated fiber mass for exposing the disintegrated fiber mass to a flow of hot drying gas to at least partially dry the free single fibers and dry the wads and lumps of the disintegrated fiber mass, and means for separating at least partly dried free single fibers from the wads or lumps of the disintegrated mass whereby the grindability of the free fibers is not substantially reduced.

22. An apparatus according to claim 21, wherein said means for exposing the fiber mass to drying air constitutes at least two flash drying stages, said separating means being adapted to to separate at least partially dried free fibers at a location between two successive flash drying stages, said apparatus further comprising means for remixing said separated at least partially dried free fibers with the remaining disintegrated fiber mass wads or lumps after the latter have passed at least one further flash drying stage.

23. An apparatus according to claim 21, wherein said separating means comprise a centrifugal separator.

24. An apparatus according to claim 23, wherein said centrifugal separator comprises a cyclone.

* * * * *